US006786624B2

(12) United States Patent
Poorman

(10) Patent No.: US 6,786,624 B2
(45) Date of Patent: Sep. 7, 2004

(54) HIGH TEMPERATURE LIGHTING BULB SHIELD

(75) Inventor: Thomas J. Poorman, Howell, MI (US)

(73) Assignee: North American Lighting, Inc., Farmington Hills, MI (US)

( * ) Notice: Subject to any disclaimer, the term of this patent is extended or adjusted under 35 U.S.C. 154(b) by 0 days.

(21) Appl. No.: 10/139,861

(22) Filed: May 6, 2002

(65) Prior Publication Data

US 2003/0227782 A1 Dec. 11, 2003

(51) Int. Cl.[7] ..... F21V 11/00; C22C 38/40
(52) U.S. Cl. ..... 362/539; 362/509; 420/97
(58) Field of Search ..... 362/539, 509; 148/327; 420/43, 94, 97

(56) References Cited

U.S. PATENT DOCUMENTS

| | | | | | |
|---|---|---|---|---|---|
| 3,679,291 | A | | 7/1972 | Apfel et al. | 350/164 |
| 4,011,642 | A | | 3/1977 | Meinecke et al. | 29/25.16 |
| 4,085,248 | A | | 4/1978 | Zehender et al. | 428/336 |
| 4,148,707 | A | * | 4/1979 | Mayer et al. | 204/297.09 |
| 4,211,822 | A | | 7/1980 | Kurfman et al. | 428/412 |
| 4,429,020 | A | | 1/1984 | Luch | 428/625 |
| 5,007,710 | A | | 4/1991 | Nakajima et al. | 350/166 |
| 5,098,652 | A | * | 3/1992 | Yasui et al. | 420/45 |
| 5,169,224 | A | | 12/1992 | Segoshi et al. | 362/61 |
| 5,267,081 | A | | 11/1993 | Pein | 359/584 |
| 5,717,057 | A | | 2/1998 | Sakashita et al. | 528/198 |
| 5,910,560 | A | | 6/1999 | Nagashima et al. | 528/196 |
| 6,000,814 | A | | 12/1999 | Nestell et al. | 362/267 |
| 6,012,830 | A | * | 1/2000 | Fraizer | 362/539 |
| 6,040,387 | A | | 3/2000 | Albrecht et al. | 525/330.5 |
| 6,122,093 | A | | 9/2000 | Lynam | 359/275 |
| 6,207,077 | B1 | | 3/2001 | Burnell-Jones | 252/301.36 |
| 6,207,236 | B1 | | 3/2001 | Araki et al. | 427/386 |
| 6,210,028 | B1 | | 4/2001 | Murakoshi et al. | 362/538 |
| 6,271,290 | B1 | | 8/2001 | Inoue et al. | 524/145 |
| 6,479,619 | B1 | * | 11/2002 | Duan | 528/286 |
| 6,495,222 | B1 | * | 12/2002 | Mosser et al. | 428/34.1 |

OTHER PUBLICATIONS

"INCONEL nickel–chromium–iron alloy 600," Special Metals Corporation, www.specialmetals.com, pp. 1–6.

* cited by examiner

*Primary Examiner*—Alan Cariaso
*Assistant Examiner*—Guiyoung Lee
(74) *Attorney, Agent, or Firm*—McDonnell Boehnen Hulbert & Berghoff LLP

(57) ABSTRACT

A method and apparatus for a high temperature corrosion resistant composition. The composition is formed into a bulb shield for a vehicle, including automobiles and motorcycles. An alloy composition may be used to stamp a bulb shield. The bulb shield may comprise a cup portion and a connector. Either the cup portion, the connector, or both may comprise an Inconel® alloy composition. The bulb shield may be positioned in front of a headlight bulb to steer light in a desired direction. The bulb shield may be electropolished to provide a decorative attribute to the lamp. The bulb shield may be exposed to high temperatures from the headlight bulb. The Inconel® composition resists deterioration and discoloration of the bulb shield due to the high temperatures. The Inconel® 600 composition also improves the durability of the bulb shield.

19 Claims, 2 Drawing Sheets

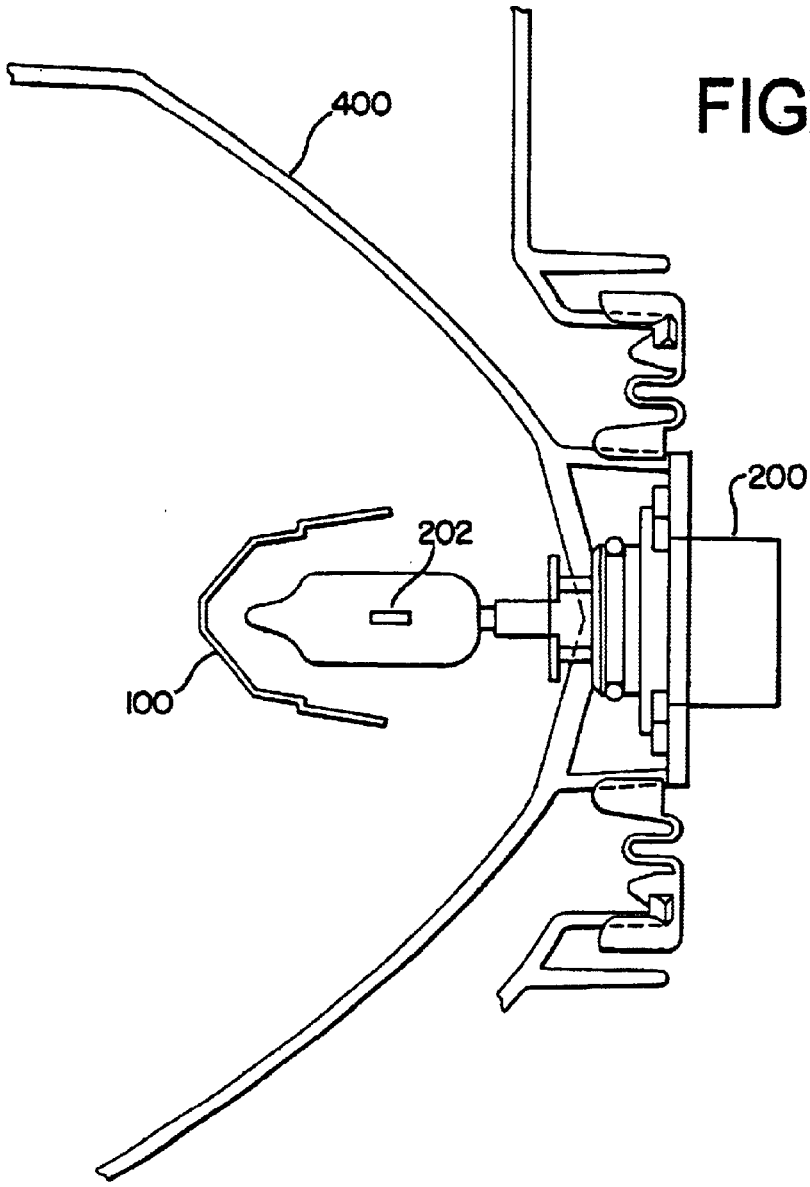
FIG. 3
FIG. 4A
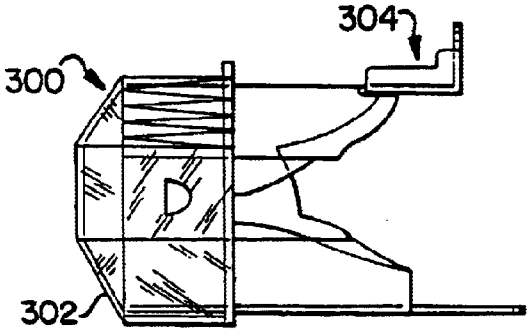
FIG. 4B
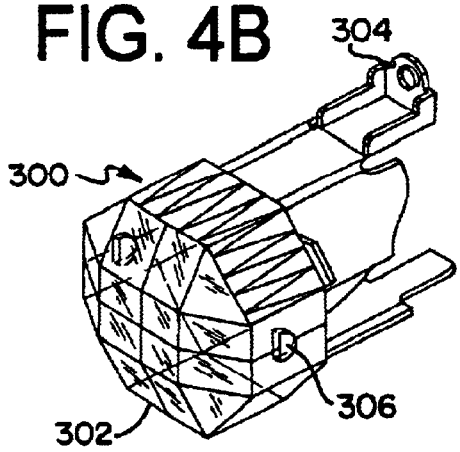

HIGH TEMPERATURE LIGHTING BULB SHIELD

FIELD OF THE INVENTION

The present invention generally relates to the field of lighting devices. More particularly, the present invention relates to a method and apparatus for providing a high temperature corrosion resistant light bulb shield.

BACKGROUND OF THE INVENTION

Typical lighting devices and illumination systems use a shield mounted to provide functional and decorative attributes. A bulb shield directs light in a desired direction. Bulb shields are typically made by stamping 300 series stainless metal, and then plating the metal with a layer of nickel. The bulb shield may then be chrome plated to enhance the outer appearance. Following the plating process, the inside portion of the bulb shield may be painted to reduce reflectivity of light rays. These materials typically discolor (they oxidate) when exposed to temperatures near or above approximately 350° C. Such temperatures are common in vehicle lighting.

The discoloration or oxidation results in a yellowish-brown outside surface color which tarnishes the appearance of the bulb shield. An outer portion of the bulb shield or an inner portion of the bulb shield may discolor and deteriorate due to the exposure to such high temperatures. The deterioration of the surface of the bulb shield limits the lifetime of the bulb shield.

The bulb shield may be used as a decorative fixture positioned in front of a lighting device. The discoloration of the bulb shield may eliminate the decorative possibilities of the bulb shield. The bulb shield may be placed through an electroplating process to provide a metal coating on the surface of the bulb shield. The metal coating may provide an added layer of protection for the bulb shield, but existing metal coating compositions lack high temperature protection. Known metal coating compositions may also deteriorate due to an exposure to high temperatures.

The use of providing a coating on lamp and headlight reflectors is generally known in the art. For example, U.S. Pat. No. 4,085,248 to Zehender (hereinafter "Zehender") discloses a method to apply a corrosion protective layer on reflective surfaces to improve the corrosion protection of vehicle headlight reflectors and other lamp reflectors that have an aluminum reflective coating. One disadvantage of the process taught by Zehender is that an extra coating over the metallization on the reflector is necessary to protect the reflective material. This extra coating is an unnecessary decorative coating which may not withstand high temperatures generated by a light bulb. Additionally, the extra coating is presented as particularly suitable as an additional clear layer for aluminum mirror surface reflectors.

U.S. Pat. No. 4,429,020 to Luch (hereinafter "Luch") discloses an electroplating process of nickel-based and tin-based metal strata that allegedly provides a desirable composite article such as headlamps. The surface metal of the headlamp should be stable to maintain the desired color and continuity. The surface metal should also resist corrosion, cracking and other undue deterioration. This electro-plating process is lengthy and fails to provide sufficient high temperature protection against discoloration. Furthermore, this process typically requires additional manufacturing steps in the production of bulb shields.

One of ordinary skill in the art will appreciate that it would be desirable to provide a bulb shield with certain resistive qualities that generally avoid discoloration of the surface of the bulb shield.

It would also be desirable to provide a bulb shield comprising a corrosive resistant compound.

It would also be desirable to provide a high temperature deterioration resistant bulb shield for use in vehicle lighting.

It would also be desirable to provide a bulb shield with a structure that may be manufactured at low costs.

It would also be desirable to provide a bulb shield that has a structural strength to withstand vibration that is typically encountered in the vehicle lighting environment.

SUMMARY OF THE INVENTION

In one aspect of the present invention, a method of forming a vehicle lighting device metal part is provided. The method comprises forming a deterioration resistant Nickel Chromium Iron alloy composition into at least a portion of a metal part having a cup portion and a connector and electropolishing the metal part. A treatment is provided onto at least a portion of the metal part.

In an alternative arrangement, an automotive lighting metal part is provided. The lighting metal part comprises a cup portion having an inner surface and an outer surface. A connector is rigidly coupled to the cup portion, wherein at least a portion of the cup portion comprises a deterioration resistant Inconel® alloy composition.

In yet another arrangement, a method of shielding a lighting device is provided. The method comprises the steps of providing a bulb shield, the bulb shield having a cup portion for covering a lighting device and a connector rigidly affixed to the cup portion for coupling the bulb shield onto a housing of the lighting device. The bulb shield is mounted onto the lighting device, wherein at least a portion of the bulb shield is comprised of a deterioration resistant alloy composition.

These as well as other features and advantages of the present invention will become apparent to those of ordinary skill in the art by reading the following detailed description, with appropriate reference to the accompanying drawings.

DESCRIPTION OF FIGURES

Exemplary embodiments of the present invention are illustrated and described herein with reference to the drawings; in which related figures have the same number but different alphabetic suffixes.

FIG. 3 is a side view of the illustration of FIG. 2;

FIG. 4A is a side view of a bulb shield arranged to operate in accordance with an exemplary embodiment of the present invention; and FIG. 4B is a diagonal view of the bulb shield of FIG. 4A.

DETAILED DESCRIPTION

According to an exemplary arrangement, a metal part for a vehicle lighting device, such as a headlight bulb shield or light bulb cover, comprises a high temperature, corrosion resistive composition. The corrosion resistive composition may resist deterioration or discoloration of the metal part due to weathering of the metal part or exposure of the metal part to high temperatures over a period of time. The corrosion resistance composition can increase the durability and lifetime of the metal part.

In a preferred arrangement, the metal part is a light bulb shield used to cover a vehicle headlight. However, those skilled in the art will recognize other examples of the metal part to be used in other lighting devices, including truck lamps, fog lamps, projection lighting devices.

Figure 1A:
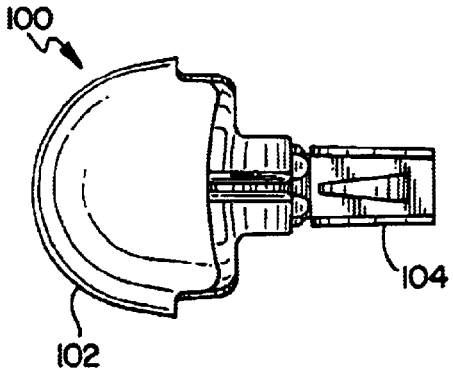
FIG. 1A is a top view of a bulb shield arranged to operate in accordance with an exemplary embodiment of the present invention.

FIG. 1A provides a top view of a bulb shield arrangement. The bulb shield 100 shown may be used for headlight applications on automobiles, motorcycles, or other vehicles as well as other lighting applications. A cup portion 102 of the bulb shield 100 may be formed to be positioned in front of a headlight bulb and collect light radiated from the bulb. In one arrangement, the cup portion 102 is about an inch deep and has a general circular shape. The cup portion 102 may have grooves on an outer surface of the cup portion 102 to provide an aerodynamically shaped bulb shield 100. Other designs are possible as well. Such designs may be a function of preferred styling features.

The bulb shield 100 may be characterized as smooth in order to comply with manufacturing and styling requirements. The cup portion 102 of the bulb shield 100 may substantially cover a middle portion of a headlight bulb. The cup portion 102 may be sized according to the size of the headlight of which the bulb shield 100 may be mounted upon.

In one arrangement, a connector 104 can be different configurations. For example, connector 104 may be attached to the cup portion 102 of the bulb shield 100. The connector 104 may be rectangular in shape and sized appropriately for coupling to a housing of a headlight. The connector 104 may be welded to the cup portion 102 of the bulb shield 100. Alternatively, the cup portion 102 of the bulb shield 100 and the connector 104 of the bulb shield 100 are one entity and are formed from one stamping die. This may reduce steps in stamping and manufacturing the bulb shield 100. Furthermore, the connector 104 of the bulb shield 100 may be operatively coupled to the cup portion 102 in such a manner as to allow for a rigid connection. The connector 104 may also be operatively coupled to a housing of a headlight by sliding into an opening on a housing of a headlight. Alternatively, the connector 104 may be attached to a housing of a headlight by other means such as welded to the headlight housing, screwed to the headlight housing, or fitted to the headlight housing.

In another arrangement, the connector 104 may be attached to a top portion of the cup portion 102 of the bulb shield 100. This allows the bulb shield 100 to be mounted to the top of a headlight bulb. Alternatively, the connector 104 of the bulb shield 100 may be attached to a bottom portion of the cup portion 102. This allows the bulb shield 100 to be mounted to the bottom of a headlight bulb. The connector 104 may also be attached to a side portion of the bulb shield 100 as well to allow for other variations in mounting the bulb shield 100 to a housing of a headlight. The manner in which the bulb shield 100 is mounted onto the headlight could effect the light distribution from the headlight.

Figure 1B:
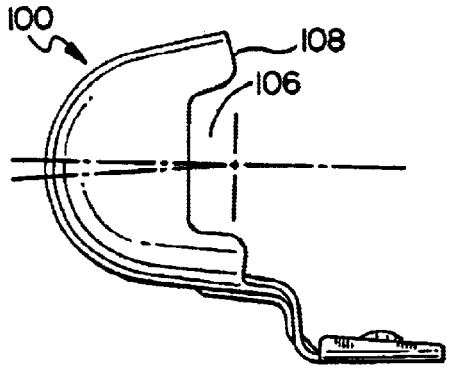
FIG. 1B is a side view of the bulb shield in FIG. 1A.

FIG. 1B is a side view of the bulb shield 100 illustrated in FIG. 1A. A slot 106 on the cup portion 102 of the bulb shield 100 aids in directing the light radiated from a headlight. A slot 106 may be present on each side of the bulb shield 106. The slot 106 may be shaped to direct light to the sides of the automobile or motorcycle reflector on which the bulb shield 100 is mounted. The cup portion 102 includes a ridge 108 with a slot 106 that defines how the light is directed to the reflector and is referred to as the shading curve.

Figure 1C:
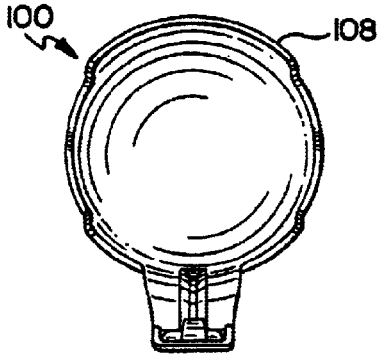
FIG. 1C is a front view of the bulb shield in FIG. 1A.

FIG. 1C is a rear view of the bulb shield 100 of FIG. 1A. In one arrangement, the cup portion 102 of the bulb shield 100 covers the lighting device. The bulb shield 100 may be mounted with respect to the lighting device such that the geometric center of the lighting device is positioned generally in front of the geometric center of the cup portion 102 of the bulb shield 100. Alternatively, the cup portion 102 of the bulb shield 100 is positioned at any position in front of the lighting device to provide a desired steering of the light rays emitted from the lighting device.

The cup portion 102 essentially aids in steering radiated light in a desired direction. Light may be collected in the bulb shield 100 and redistributed to the various sides of the bulb shield 100. The headlight can illuminate an area in front of a vehicle and along the sides of a vehicle using the bulb shield 100. Areas in front of the vehicle may be illuminated using reflected light, whereas the bulb shield determines which light rays reach the reflector.

Figure 2A:
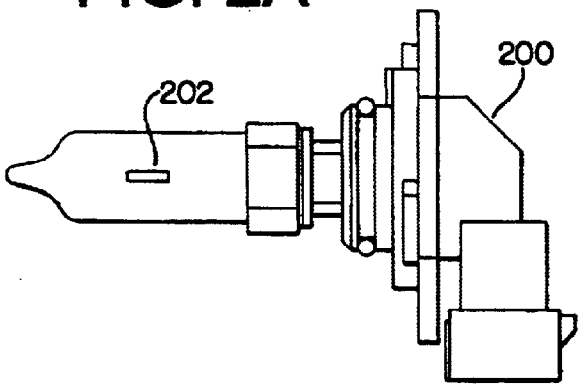
FIG. 2A is a side view of an illustration showing an automotive light bulb device and an illuminating filament.
Figure 2B:
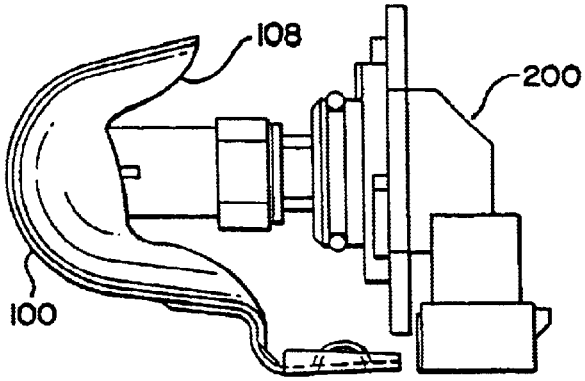
FIG. 2B is a side view of the lighting device with bulb shield positioned with respect to a filament.

FIG. 2A is a side view of an illustration showing an automotive light bulb device 200 and an illuminating filament 202. Electric current flowing through filament 202 heats filament to create visible radiation that is emitted from the filament. FIG. 2B is a side view of the lighting device 200 with bulb shield 100 positioned with respect to filament 202. Positioning of the bulb shield 100 absorbs forward direction emitted light rays. Shape of bulb edge 108 will determine which radiated light rays may be used for illumination in front of the automobile.

In one arrangement, the radiated light is incident onto a reflector. FIG. 3 shows a side cross sectional view of a light bulb device 200 with a bulb shield 100 and reflector 400. Some of the radiated light from the filament 202 is absorbed by the bulb shield 100 and is converted to heat. A portion of the radiated light reflects off of reflector 400. Shape of reflector 400 is approximately parabolic and may have facets. Reflector shape is designed to project light rays in front of a vehicle without excessive glare light to oncoming vehicles. Without a bulb shield, such as for a high beam function, glare into oncoming vehicles may increase the occurrence of traffic accidents.

FIG. 4A is a side view of an alternative bulb shield arrangement. The headlight bulb shield 300 shown has nine sides on the face of the shield. The headlight bulb shield 300 has a cup portion 302 and a connector 304. The connector 304 may be operatively coupled to the cup portion 302. The connector 304 may also be operatively coupled to a housing of a headlight of an automobile or motorcycle. The connector 304 may be screwed to a headlight housing. The headlight 300 bulb shield is illustrated as having a steering slot 306 on each side of the cup portion 302 to aid in steering light rays emitted from a lighting device. The steering slot 306 may be sized and shaped to provide a desired light distribution spread of the lighting device. Referring to FIG. 4B, a diagonal view of the headlight bulb shield of FIG. 4A is shown. The bulb shield 100, and the headlight bulb shield 200 are two arrangements of typical bulb shields used in automotive lighting, although those skilled in the art will recognize that other configurations such as ring shaped may be used.

The entire metal part can comprise of a high temperature corrosion resistive material. In the embodiment of a bulb shield, the cup portion 102 and the connector 104 of the bulb shield 100 are comprised of a high temperature resistive material.

Alternatively, only a portion of the metal part may include a high temperature resistive material. For example, only the cup portion 102 of the bulb shield 100 is comprised of the resistive material. Furthermore, only an inner portion, an outer portion, or both an inner portion and an outer portion of the cup portion 102 of the bulb shield 100 comprise a high temperature resistive material. Moreover, only a top outer portion of the cup portion 102 of the bulb shield 100 may be comprised of the high temperature corrosion resistive material since the top outer portion of the bulb shield 100 may be subject to increased temperature as well as radiation from bulb filament 202.

The portion of the bulb shield 100 which is comprised of the resistive material may be exposed to a high temperature lighting device 200. The lighting device 200 radiates light rays, and the surfaces of the bulb shield 100 are therefore subject to increased temperature due to an exposure of the radiated light. In one embodiment, a bulb shield 100 positioned in front of the lighting device is exposed to a high temperature environment for a long period of time. An outer surface of the bulb shield 100 may be heated due to the exposure of a high temperature which may cause harmful effects, such as oxidation in the form of discoloration, tarnishing, and deterioration of the bulb shield 100. Therefore, the high temperature resistive material aids in the durability and lifetime of the bulb shield 100.

In a preferred arrangement a high temperature and corrosion resistant material such as Inconel® 600 alloy is used to stamp the metal part. However, those skilled in the art will recognize other alternatives such as Inconel 625, 617, 718, 864, Incoloy alloys, UDIMET, BE-NI, NIMONIC.

Inconel® 600 alloy is a non-magnetic nickel-chromium alloy with oxidation resistance at higher temperatures, such as 2000° F. (1093° C.). Inconel® 600 has a high nickel content within the alloy. The high nickel content of the alloy enables the alloy to retain considerable resistance under operating conditions and makes the alloy resistant to corrosion by a number of organic compounds and inorganic compounds. The additional chromium content of the Inconel® 600 alloy enables the Inconel® 600 alloy to resist sulfur compounds, various oxidizing environments, and other generally known harmful elements.

Inconel® 600 is typically employed in furnace muffles, electronic components, heat-exchanger tubing, chemical and food processing equipment, carburizing baskets, fixtures and retorts, reactor control rods, nuclear reactors, primary heat-exchanger tubing, and primary water piping. The resistant attributes of the alloy benefit the use of the Inconel® 600 alloy for these applications. Inconel® 600 is mainly comprised of nickel, chromium, and iron although small percentages of other elements may be present as well. Inconel® 600 alloy may be readily joined to itself or to other metals by standard welding, brazing and soldering processes. In one arrangement, the chemical composition of Inconel® 600 is about 72% Nickel (Ni), 0–0.15% Carbon (C), 0–1.0% Manganese (M), 6–10% Iron (Fe), 0–0.015% Sulfur (S), 0–0.5% Silicon (Si), 0–0.5% Copper (Cu), and 14–17% Chromium (Cr). Typically, the chemical composition of Inconel® 600 alloy is 6–10% Iron (Fe), 14–17% Chromium (Cr), and the balance Nickel (Ni).

In one arrangement, the Inconel® 600 composition is stamped, molded, and formed into a desired size and shape. In a preferred embodiment, a bulb shield 100 is manufactured and comprises Inconel® 600 composition. The bulb shield 100 may be stamped into a cup or half of an oval shape. The bulb shield 100 may be hollow in order to collect light rays emitted from a lighting device. Other shapes that may be used for bulb shields include a bullet shape, hexagonal, octagonal, diamond, ribbed, slotted, etc. The connector 104 of the bulb shield 100 may also be stamped using the Inconel® 600 alloy or alternatively, 300 series stainless. The connector 104 may be stamped separately from the cup portion 102 of the bulb shield 100 and then operatively coupled to the bulb shield 100, or the connector 104 may be stamped together as one integral entity with the cup portion 102 to form a bulb shield 100.

After stamping and welding a preferred alloy composition, an electropolishing process is applied to the metal part formed to create a decorative finish on the surface of the metal part. Electropolishing, sometimes referred to as "reverse plating," uses a combination of rectified current and a blended chemical electrolyte bath to remove certain flaws and imperfections from the outer and inner surfaces of a metal part. Flaws may be present due to the stamping and annealing processes of the metal part. Imperfections such as indentures, cracks, slits, burrs and pitting may be present in the metal part. Electropolishing may refinish the inner and outer surfaces of the metal part, without the addition of an extra layer to provide a polished surface.

A power source used in the electropolishing process converts AC current to DC at low voltages. A tank typically fabricated from steel and rubber-lined, is used to hold an electrolyte chemical bath. A series of lead, copper, or stainless steel cathode plates are lowered into the bath and installed to a negative (−) side of the power source. The metal part or a group of metal parts are connected to a rack typically made of titanium, copper or bronze. The rack is connected to the positive (+) side of the power source. The metal part then is charged positive and immersed into the chemical bath.

When a current is applied to the rack of metal parts, the electrolyte chemical bath acts as a conductor to allow metal ions to be removed from the metal parts. While the ions are drawn toward the cathode plates, the electrolyte chemical bath maintains the dissolved metal ions in solution. The metal part may be significantly smoother after removing the metal ions. The surface of the metal part may also be shiny and reflective after removing the metal ions. The reflective surface decoratively matches other features of the lighting device. A typical layer of metal ions removed from a metal part is approximately 0.0005–0.0020 inches.

Gassing in the form of oxygen occurs at the surface of the metal parts, enhancing the electropolishing cleaning process. Once the electropolishing process is complete, the metal part is run through a series of cleaning and drying steps to remove clinging electrolytes. The resultant surface of the metal part is clean and bright. Some benefits of the electropolishing process include deburring, size control, microfinish improvement, removal of imperfections, and others (improved oxidation resistance).

In one arrangement, electropolished metal parts are stress-free and smooth. Electropolishing improves adhesion through the removal of oils, oxides, and other imperfections. Electropolishing can also remove corrosion on metal parts. This may aid in the welding process of the metal parts. Electropolishing is a technique for finishing oddly shaped metal parts. Furthermore, electropolishing may be able to resize any metal part to a precise and correct measurement. This may be completed by allowing the metal part to reside in the electrolyte chemical bath solution for a predetermined amount of time. Through this controlled process, the electrolyte chemical bath will erode the metal part to a desired size. Electropolishing effectively eliminates many secondary finishing processes. Burrs (i.e., sharp edges), weld marks, and scales from heat treatment can also be removed from metal parts using the electropolishing process.

In one arrangement, after the electropolishing process, a treatment may be applied to an inside portion of the metal part to reduce reflectivity. An example of a treatment may be paint applied to the surfaces of the metal part. The painting may be in the form of a spray painting process. In a preferred arrangement, a black paint is used to absorb radiation from the bulb filament 202. In yet an alternative arrangement, an inside portion of the cup of a bulb shield is painted. The inner surface of the metal part may be exposed to high temperatures. The painting or coating of the inner surface may allow the metal part to perform more effectively at high temperatures. The painting may also decrease glare, light and effectiveness of the bulb shield.

Various arrangements of the present invention have been illustrated and described. It will be understood, however, that changes and modifications may be made without deviating from the scope or extent of the present invention, as defined by the following claims. In view of the wide variety of arrangements to which the present principles and discussion can be applied, it should be understood that the illustrated arrangements are exemplary only, and should not be taken as limiting the scope or extent of the present invention.

The claims should not be read as limited to the described order or elements unless stated to that effect. Therefore, all arrangements that come within the scope and spirit of the following claims and equivalents thereto are claimed as the invention.

I claim:

1. A method of forming a vehicle lighting device metal part comprising:

forming a deterioration resistant Nickel Chromium Iron alloy composition into at least a portion of a metal part having a cup portion and a connector;

electropolishing the metal part; and applying a treatment onto at least a portion of the metal part wherein the deterioration resistant alloy composition comprises about 14–17% Chromium (Cr), about 6–10% Iron (Fe), and a balance Nickel (Ni).

2. The method of claim 1, wherein the deterioration resistant alloy composition comprises about 14–17% Chromium (Cr), about 6–10% Iron (Fe), and about 72% Nickel (Ni).

3. The method of claim 1, wherein the metal part is a bulb shield for a vehicle headlight on a motorcycle.

4. The method of claim 1, wherein the treatment is selected from the group consisting of paint, metallization, chrome sputtering, and aluminum coating.

5. The method of claim 1, wherein applying a treatment comprises painting an inner portion of the metal part.

6. The method of claim 1, wherein the cup portion comprises the deterioration resistant alloy composition.

7. The method of claim 1, wherein the connector comprises the deterioration resistant alloy composition.

8. The method of claim 1, wherein the connector and the cup portion comprise the deterioration resistant alloy composition.

9. An automotive lighting metal part comprising in combination:

a cup portion having an inner surface and an outer surface; and a connector rigidly coupled to the cup portion, wherein at least an electropolished portion of the cup portion comprises a deterioration resistant alloy composition, wherein the deterioration resistant alloy composition comprises approximately 14–17% Chromium (Cr), approximately 6–10% Iron (Fe), and approximately balance Nickel Ni).

10. The method of claim 9, wherein the deterioration resistant alloy composition comprises approximately 14–17% Chromium (Cr), approximately 6–10% Iron (Fe), and approximately 72% Nickel (Ni).

11. The automotive lighting metal part of claim 9, wherein the connector is comprised of the deterioration resistant alloy composition.

12. The automotive lighting metal part of claim 9, wherein the automotive lighting metal part is a bulb shield for a headlight on a motorcycle, or fog lamp, or automotive head lamp, or truck head lamp.

13. The automotive lighting metal part of claim 9, wherein the inner surface of the cup portion is comprised of the deterioration resistant alloy composition.

14. The automotive lighting metal part of claim 9, wherein the outer surface of the cup portion is comprised of the deterioration resistant alloy composition.

15. The automotive lighting metal part of claim 9, wherein the outer surface and the inner surface of the cup portion are comprised of the deterioration resistant alloy composition.

16. The automotive lighting metal part of claim 9, wherein the inner portion of the cup portion has a treatment thereon.

17. The automotive lighting metal part of claim 16, wherein the treatment is selected from the group consisting of paint, metallization, chrome sputtering, and aluminum coating.

18. A method of shielding a lighting device comprising the steps of:

providing a bulb shield, the bulb shield having a cup portion for covering a lighting device and a connector rigidly affixed to the cup portion for coupling the bulb shield onto a housing of the lighting device; and mounting the bulb shield onto the lighting device, wherein at least a portion of the bulb shield comprises a deterioration resistant alloy composition electropolishing the portion of the bulb shield, wherein the deterioration resistant alloy composition comprises substantially 14–17% Chromium (Cr), substantially 6–10% Iron (Fe), balance Nickel (Ni).

19. The method of claim 18, wherein the deterioration resistant alloy composition comprises substantially 14–17% Chromium (Cr), substantially 6–10% Iron (Fe), and substantially 72% Nickel (Ni).

* * * * *